US006079754A

United States Patent [19]

Alexy

[11] Patent Number: 6,079,754

[45] Date of Patent: Jun. 27, 2000

[54] LATCHING ASSEMBLY FOR INSULATION PANELS

[76] Inventor: Fred H. Alexy, 37 Overlook Dr., Queensbury, N.Y. 12804

[21] Appl. No.: 09/210,789

[22] Filed: Dec. 15, 1998

Related U.S. Application Data

[60] Provisional application No. 60/075,344, Feb. 20, 1998.

[51] Int. Cl.[7] ..... E05C 19/10

[52] U.S. Cl. ..... 292/101; 292/95; 292/202; 52/127.8; 52/127.9; 52/127.11

[58] Field of Search ..... 52/127.8, 127.9, 52/127.11; 292/240, 241, 202, 95, 101, DIG. 38, 107, 326; 403/321, 322.1, 329; 70/379 R; 267/158, 163

[56] References Cited

U.S. PATENT DOCUMENTS

| | | | |
|---|---|---|---|
| 2,019,692 | 11/1935 | Mueller . | |
| 2,340,864 | 2/1944 | Carpenter | 52/127.9 |
| 2,581,816 | 1/1952 | Schlueter . | |
| 2,647,287 | 8/1953 | Jones . | |
| 2,741,341 | 4/1956 | Anderson | 52/127.9 |
| 3,191,244 | 6/1965 | Burke | 52/127.9 |
| 3,280,522 | 10/1966 | Palfey et al. . | |
| 3,327,447 | 6/1967 | Nissley . | |
| 3,353,314 | 11/1967 | Melcher . | |
| 3,400,958 | 9/1968 | Haimes et al. | 52/127.9 |
| 3,472,545 | 10/1969 | Berkowitz | 52/127.9 |
| 3,496,692 | 2/1970 | Melcher | 52/127.9 |
| 3,565,469 | 2/1971 | Zwart | 52/127.9 |
| 3,661,410 | 5/1972 | Larson et al. | 52/127.9 |
| 3,671,006 | 6/1972 | Berkowitz | 52/127.9 |
| 3,679,252 | 7/1972 | Howie, Jr. | 292/349 |
| 3,712,653 | 1/1973 | Lehmann . | |
| 4,020,613 | 5/1977 | Reynolds et al. . | |
| 4,223,500 | 9/1980 | Clark et al. | 52/127.9 |
| 4,507,010 | 3/1985 | Fujiya | 52/127.9 |
| 4,512,122 | 4/1985 | Berkowitz | 52/127.9 |
| 4,574,537 | 3/1986 | Krieger . | |
| 4,625,477 | 12/1986 | Johnstonbaugh | 52/127.9 |
| 4,641,988 | 2/1987 | Ganner | 52/127.9 |
| 4,655,013 | 4/1987 | Ritland | 52/127.9 |
| 4,918,879 | 4/1990 | Bodurow et al. | 52/127.9 |
| 5,038,535 | 8/1991 | Van Praag, III | 52/127.9 |
| 5,060,993 | 10/1991 | Maier | 52/127.9 |
| 5,212,924 | 5/1993 | Finkelstein | 52/127.9 |

OTHER PUBLICATIONS

Conventional Cam–Lock Construction, admitted prior art.

*Primary Examiner*—Teri Pham
*Attorney, Agent, or Firm*—Nixon & Vanderhye P.C.

[57] ABSTRACT

A latching assembly, such as for use in assembling and disassembling mating foamed insulating panels, may have housing components of inexpensive materials such as cellulosic or non-structural plastic materials. A cam shaft passes through an opening in a latch, the cam shaft mounting a cam keeper which has its peripheral surface engaged by a friction clutch (e.g. a cantilevered tongue) which supplies a radial or axial spring force from the exterior of the cam keeper to provide high level of predictable friction force. The cam shaft, and a latching pin for cooperation with hook portion of the latch, are mounted by metal or structural plastic flanges which engage the inexpensive housing components. An external clutch, such as a spring tab integral with the second metal or structural plastic flange, maintains the position of the cam shaft with respect to the flange unless the cam shaft is positively rotated.

21 Claims, 5 Drawing Sheets

Fig. 3
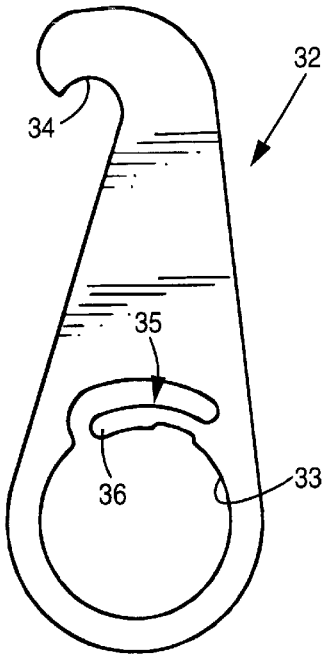
Fig. 4
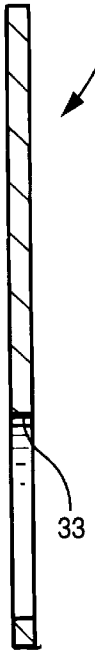
Fig. 5
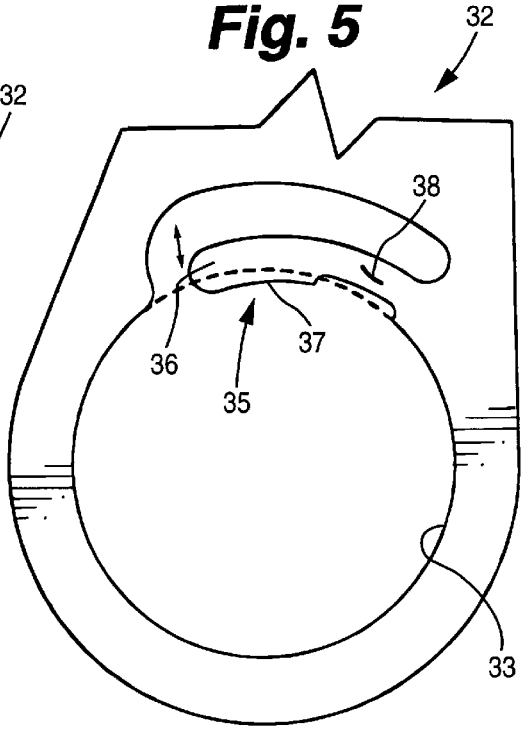
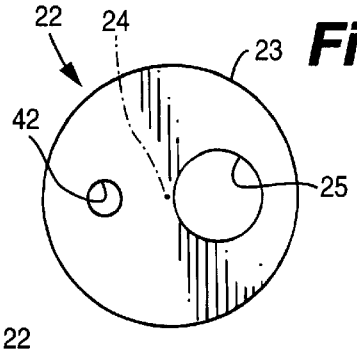
Fig. 6
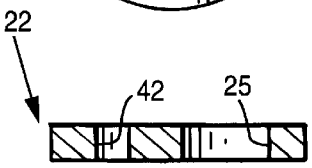
Fig. 7
Fig. 10
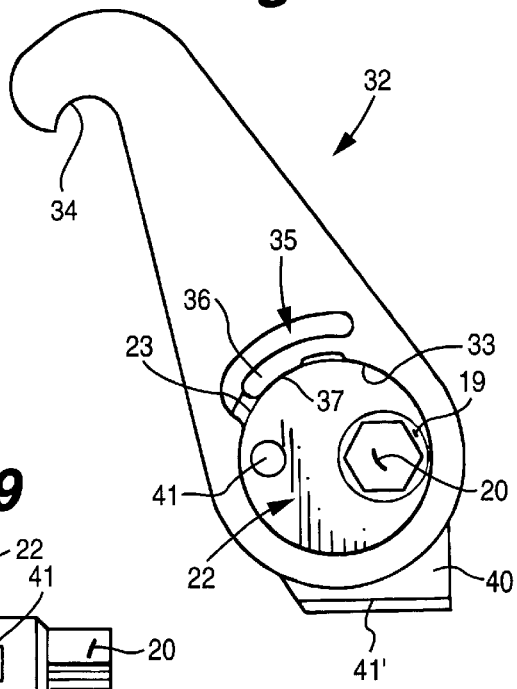
Fig. 8
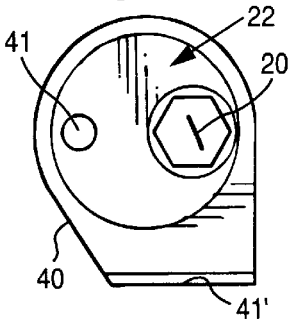
Fig. 9
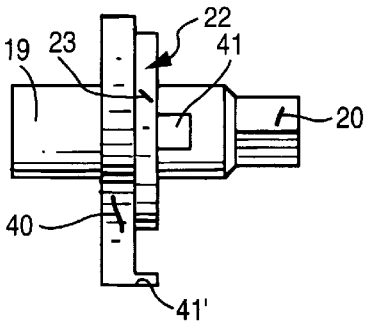

LATCHING ASSEMBLY FOR INSULATION PANELS

CROSS-REFERENCE TO RELATED APPLICATION

This application is based upon provisional application Ser. No. 60/075,344 filed Feb. 20, 1998.

BACKGROUND AND SUMMARY OF THE INVENTION

A "cam-lock" is a coined name for a two part device that conveniently assembles and clamps, and unclamps and disassembles, mating foamed insulating panels. These panels are typically provided as the walls, roof and floor of large commercial coolers, freezers and other enclosures requiring high insulation. The cam-lock components are cast in and become a permanent part of a foamed panel.

The first, or the passive female, half of the cam-lock contains a pin fastened in a first housing component. The housing is configured to provide an operating clearance for and clamping of the latch, contained in the male part of the cam-lock. The housing must be made of sturdy materials to prevent the collapse of the void in the foam insulation created by the housing and to withstand the elevated temperatures and pressures during the expansion phase of the foam formation in the insulating panel manufacture process. Further, the housing becomes an essential structural part of the cam-lock assembly.

The second, or male, half of the cam-lock is similarly configured to hold the rotatable latch and cam. It is the active half of the two part device. The housing must be made of sturdy materials to prevent the collapse of the void in the foam insulation created by the housing and to withstand the elevated temperatures and pressures during the expansion phase of the foam formation in the panel manufacture process. This housing component becomes an essential structural part of the assembly.

It is essential that the latch of the enclosed cam/latch sub-assembly have a high and predictable frictional contact with the cam to prevent the latch from rotating about the cam unless it is deliberately rotated by an external force. This is to assure that the latch is in an "open" position to capture the pin in the female half of the cam-lock when assembling two mating panels. This is accomplished by adding a friction clutch device that operates from inside the cam to exert either axial or radial pressures between the latch and the cam.

Similarly, it is important that the cam/latch sub-assembly within the housing have a high and predictable frictional contact with the housing to prevent the sub-assembly from aimlessly rotating within the housing and possibly position itself as an obstruction to engaging the mating panels in preparation to be cammed together. This is typically attempted by maintaining close and tight manufacturing tolerances at the bearing points between the cam/latch sub-assembly and the enclosing housing.

For "hoop" strength in the completed structure, male and female cam-locks are typically joined together with a tie strap spanning the width of each panel. The tie straps that connect a male and female unit together are generally steel, attached to the cam-lock housing components by welding, riveting or other suitable fastening method.

The cam-lock is made by a number of different manufacturers in the U.S.A. and Europe. All share the same concept of making the housing and the internal parts as a working entity, requiring that the housing behave as a working structural part of the finished structure. Most housing components are made of steel, although there is at least one manufacturer that makes the housing in a sturdy, structural, plastic. Most have flanges for additional security in the panel.

The existing housing design has been manufactured for many years. The costs have been reduced to essentially the lowest possible value, and alternatives to reducing the cost further have proven elusive. Also the existing friction clutch design is unnecessarily complex and in existing installations permits the latch to move axially. Also difficulties in maintaining the manufacturing tolerances between the cam shaft and the housing bearing permit the cam/latch sub-assembly to freely rotate in some cam-locks. Finally where male and female tie straps are impractical, the security of the cam-lock is limited to the housing flanges.

According to the present invention a cam-lock is provided which overcomes the problems with existing cam-lock designs, as is reiterated above. According to the present invention the costs of the cam-lock are greatly reduced by reducing the cost of housings. The metal, typically steel, or structural plastic housings in the prior art are replaced by housing components of less expensive materials, such as cellulosic material or non-structural plastic. For example corrugated paper, paperboard, cardboard, or vacuum formed plastic, may be utilized for the housing component, permitting a dramatic reduction in material costs and labor. However structural integrity is maintained by utilizing particular flanges of metal (such as steel) or structural plastic (such as ABS), as the structural elements instead of the housing.

The problems with conventional friction clutches are also solved according to the present invention by providing an external friction clutch typically which provides a frictional force on the periphery of the cam, so that the latch rotates with the cam unless there is a definitive external force. Ties between adjacent cam lock assemblies are provided directly between the flanges, not to the housings. Neighboring cam-locks along the same edge of a panel can be mounted in a common flange, which dramatically improves strength in the finished panel. Also, to eliminate the undesirable free spinning of the cam/latch sub-assembly in the housing, according to the invention an external clutch is provided which impresses a substantially constant pressure on the protruding cam shaft.

According to one aspect of the present invention a latching assembly is provided comprising the following components: A latching pin mounted to a first flange or panel. A cam shaft, having a cam keeper positioned thereon, operatively mounted to a second flange or panel. The cam keeper having a substantially peripheral surface, a center, and an opening through which the cam shaft passes having the center thereof radially spaced from the cam keeper center. A latch having an opening therein for receipt of the cam keeper, the latch including a latch hook which cooperates with the latching pin to latch the first and second flanges or panels together. And, a friction clutch which supplies a radial or axial spring force from the exterior of the cam keeper to the cam keeper so as to provide frictional contact between the latch at the opening and the substantially peripheral surface of the cam keeper of sufficient magnitude and precision to ensure that the latch rotates with the cam shaft unless an external force is applied to deliberately rotate the latch with respect to the cam shaft.

The friction clutch preferably comprises a cantilevered tongue integral with the latch and having a portion thereof extending into spring-pressed engagement with the cam keeper peripheral surface. The tongue typically includes a thinned portion to provide flexibility thereof, and the latch is typically of metal (such as spring steel) or a sturdy but flexible plastic.

The latching assembly may further comprise a stop integral with the cam shaft and having a keeper pin extending axially outwardly therefrom substantially parallel to the cam shaft; and then the cam keeper has a keeper-pin receiving opening formed therein for receipt of the keeper pin to stabilize the position of the cam keeper on the cam shaft. The cam shaft typically comprises a non-round end surface (such as a hex or grooved structure) for engagement by a cooperating non-round tool element to effect rotation thereof.

Preferably the first and second flanges or panels comprise a first metal or structural plastic flange substantially integral with the latching pin, the latching pin extending in a direction of elongation with respect to the first flange; and a second metal or structural plastic flange which mounts the cam shaft for rotation about an axis substantially parallel to the direction of elongation of the latching pin. The assembly preferably further comprises a housing of primarily cellulosic material or non-structural plastic formed by cooperating first and second hollow housing components each having first and second faces, the first metal flange engaging the first and second faces of the first housing component, and the second metal flange engaging the first and second faces of the second housing component, and the latching pin, latch, and cam disposed within the housing. The housing components preferably are male and female components of corrugated paper, paperboard, cardboard, or vacuum formed plastic. Foamed thermal insulation preferably encompasses each housing component except an open end portion thereof which cooperates with (e.g. abuts) the other hollow housing component.

The latching assembly may also further comprise an external clutch associated with the second metal or structural plastic flange and exerting a force on the cam shaft to maintain the cam shaft and the second metal or structural plastic flange together until the cam shaft is positively rotated with respect to the second flange by an external force. For example the external clutch may comprise a spring loaded tab integral (one-piece) with the second flange.

The latching assembly may comprise a first latching assembly, and the first latching assembly may be in combination with a second (or more) latching assembly substantially the same as the first latching assembly. Under these circumstances the first and second flanges may be elongated, and both the first and second latching assemblies are mounted to the first and second flanges spaced from each other in a dimension substantially perpendicular to the axis of rotation of the cam shafts, and so that the cam shafts of the first and second latching assemblies are substantially parallel to each other.

According to another aspect of the present invention a latching assembly is provided comprising the following components: A latching pin mounted to a first metal or structural plastic flange. A cam shaft operatively mounted to a second metal or structural plastic flange. A latch operatively connected to the cam shaft, the latch including a latch hook which cooperates with the latching pin to latch the first and second flanges together. And, the first flange substantially integral with the latching pin, the latching pin extending in a direction of elongation with respect to the first flange; and the second flange mounting the cam shaft for rotation about an axis substantially parallel to the direction of elongation of the latching pin. The details of the components are preferably as described above.

According to yet another aspect of the present invention a latching assembly is provided comprising the following components: A latching pin mounted to a first metal or structural plastic flange or panel. A cam shaft operatively mounted to a second metal or structural plastic flange. A latch operatively connected to the cam shaft, the latch including a latch hook which cooperates with the latching pin to latch the first and second flanges or panels together. And, an external clutch associated with the second metal or structural plastic flange or panel and exerting a force on the cam shaft to maintain the cam shaft and the second metal or structural plastic flange or panel together until the cam shaft is positively rotated with respect to the second flange by an external force. The external clutch typically comprises a spring loaded tab integral (one-piece) with the second flange or panel, and the rest of the components are preferably as described in detail above.

It is the primary object of the present invention to provide an improved latching assembly, such as for use in assembling and disassembling mating foamed insulation panels that comprise the walls, roof, and floor of large commercial coolers, freezers, or other enclosures requiring high insulation. This and other objects of the invention will become clear from an inspection of the detailed description of the invention and from the appended claims.

BRIEF DESCRIPTION OF THE DRAWINGS

FIG. 3 is a detail side view of the latch of the latching assembly of FIG. 1;

FIG. 4 is a longitudinal cross-sectional view of the latch of FIG. 3;

FIG. 5 is a detail side view of the latch of FIGS. 3 and 4 and showing the friction clutch according to the present invention in detail;

FIG. 6 is a side view of the cam keeper of the latching assembly of FIG. 1;

FIG. 7 is a side cross-sectional view of the cam keeper of FIG. 6;

FIG. 8 is a end view of the cam keeper, cam shaft, stop sub-assembly of the latching assembly of FIG. 1;

FIG. 9 is a side view of the sub-assembly of FIG. 8;

FIG. 10 is a side view of the cam/latch sub-assembly of the latching assembly of FIG. 1;

DETAILED DESCRIPTION OF THE DRAWINGS

Figure 2:
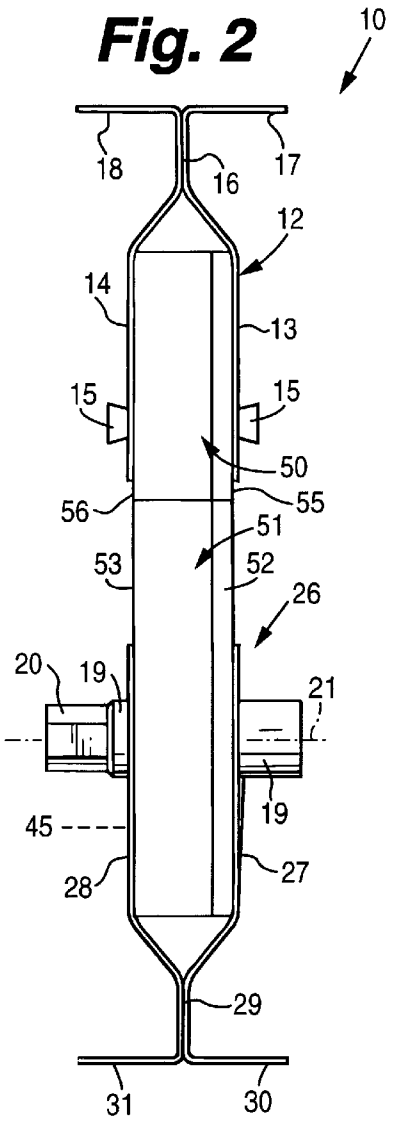
FIG. 2 is an end of the latching assembly of FIG. 1.
Figure 1:
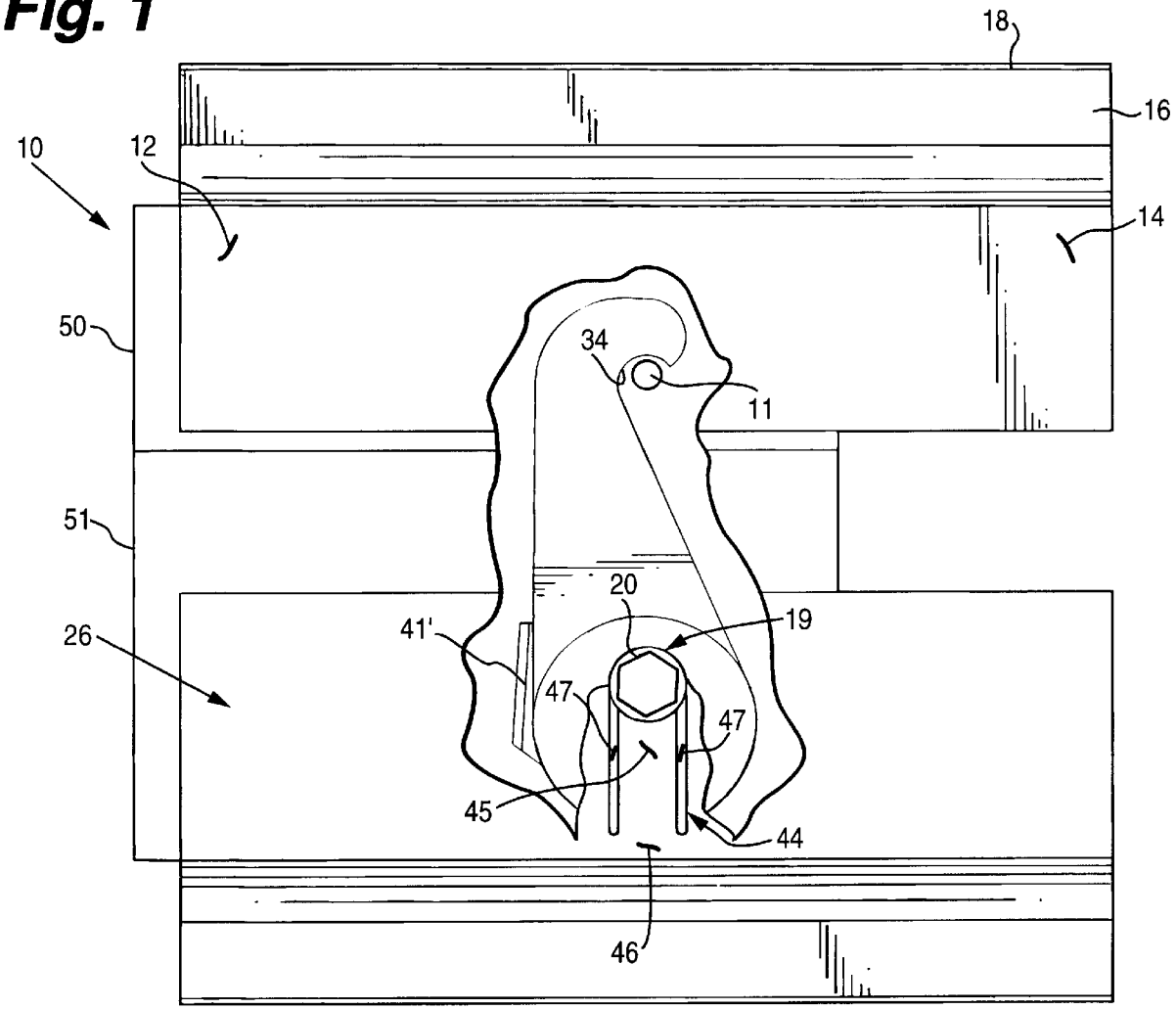
FIG. 1 is a side view of a latching assembly according to the present invention with portions of the flanges and housing components cut away to illustrate the latch and latch pin therein.

An exemplary latching assembly according to the present invention is shown generally by reference numeral 10 in FIGS. 1 and 2. In FIG. 1 various components are cut away to illustrate internal structures of the latching assembly.

One component of the latching assembly 10 comprises a latching pin 11 mounted to a first flange or panel. In the embodiment illustrated in the drawings the pin 11 is mounted to a first metal or structural plastic flange 12, the pin extending completely through the side walls 13, 14 (see FIG. 2) of the flange 12 and having flared end portions 15 thereof which prevent the pin 11 from moving out of contact with the first flange 12. The flange 12 typically has a double thickness portion 16, and bent over top end portions 17, 18.

The latching assembly 10 further comprises a typically metal cam shaft 19, including a non-round (e.g. hexagonal in the embodiment illustrated) end surface 20 for engagement by a cooperating non-round tool element (such as a socket wrench) to effect rotation of the cam shaft 19 about an axis 21 that is substantially parallel to the latching pin 11.

The cam shaft 19 has a cam keeper 22 keeper (see FIGS. 6 through 10) positioned thereon. The cam keeper 22, which typically is of metal such as steel, has a substantially peripheral surface 23, a center, shown at 24 in FIG. 6, and an opening 25 having the center thereof radially spaced from the cam keeper center 24. The cam shaft 19 passes through the opening 25.

The cam shaft 19 is operatively mounted to a second flange or panel, shown mounted to the metal or structural second flange 26 in the embodiment of FIGS. 1 and 2. The cam shaft 19 extends through openings in the side faces 27, 28 of the second flange 26, for rotation about the axis 21. The flange 26 also—like the flange 12—has a double thickness portion 29 and end ears 30, 31.

The assembly 10 further comprises a latch 32 (see FIGS. 1, 3 through 5, and 10), typically of metal such as steel or spring steel, having an opening 33 therein for receipt of the cam keeper 22, and including a latch hook 34 which cooperates with the latching pin 11 (see FIG. 1) to latch the first and second flanges 12, 26 together.

The latching assembly 10 further comprises a friction clutch—shown generally by reference numeral 35 in FIGS. 3, 5, and 10—which supplies a radial or axial spring force from the exterior of the cam keeper 22 (preferably to the substantially peripheral surface 23 thereof) so as to provide frictional contact between the latch 32 at the opening 33 and the substantially peripheral surface 23 of the cam keeper 22 of sufficient magnitude and precision to ensure that the latch 32 rotates with the cam keeper 22 unless an external force is applied to deliberately rotate the latch 32 with respect to the cam keeper 22. The friction clutch 35 preferably comprises a cantilevered tongue 36 integral (one-piece) with the latch 32 and having a portion 37 thereof (see FIG. 5) spring-pressed into engagement with the cam keeper substantially peripheral surface 23. The tongue 36 typically includes a thinned portion 38 (see FIG. 5) to provide flexibility thereof so that the tongue 36 can move radially.

In the preferred embodiment, the latching assembly 10 further comprises a stop 40 (see FIGS. 1 and 8 through 10) typically also of metal or structural plastic, and including a keeper pin 41 which extends through a keeper pin-receiving opening 42 (see FIGS. 6 and 7) in the cam keeper 22. The keeper pin 41 helps to stabilize the position of the cam keeper 22 on the cam shaft 19. The stop 40 includes a stop surface portion 41'.

In the preferred embodiment the assembly 10 further comprises an external clutch, shown generally by reference numeral 44 in FIG. 1, associated with the second flange 26 and exerting a force on the cam shaft 19 to maintain the cam shaft 19 and the flange 26 together until the cam shaft 19 is positively rotated with respect to the flange 26 by an external force. In the preferred embodiment the external clutch 44 comprises a spring loaded tab 45 integral (one-piece) with the second flange 26, at the root portion 46 thereof but unconnected at the sides 47 thereof to the rest of the flange 26.

Figure 13:
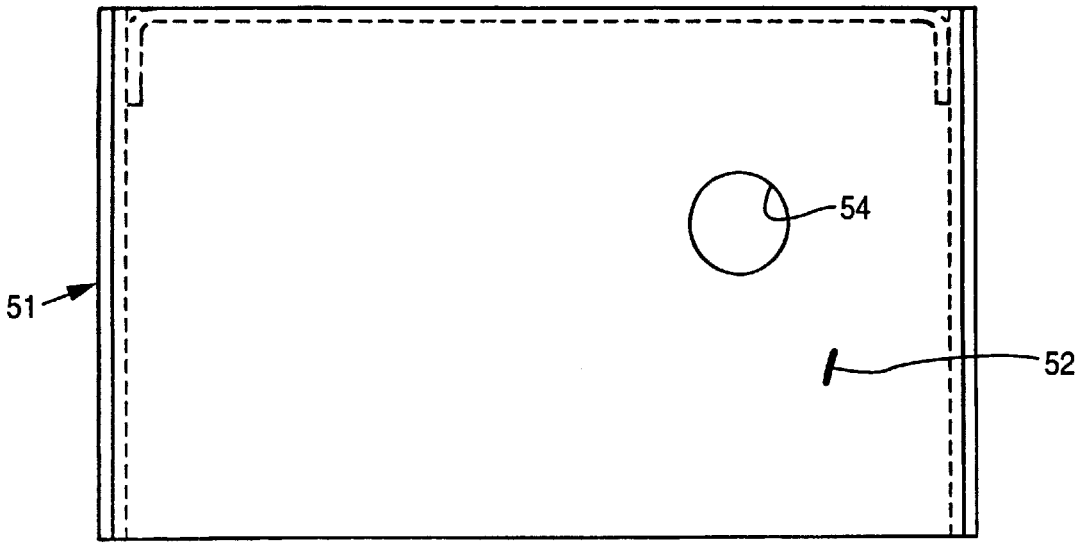
FIGS. 13 and 14 are side views of the male and female housing components, respectively, of the housing of the latching assembly of FIG. 1.
Figure 14:
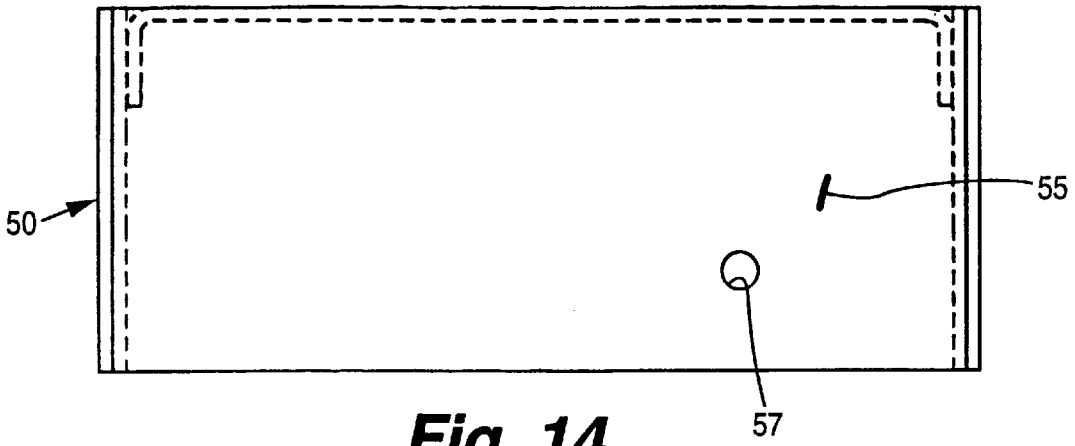
Figure 15:
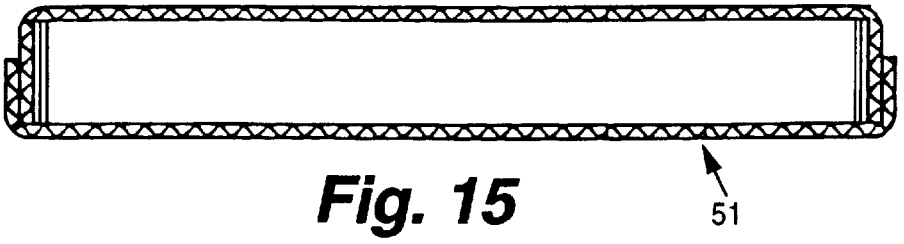
FIG. 15 is an end, looking at the open end, of the male housing component in FIG. 13, the female housing component end view being substantially the same.

The assembly 10 further comprises a housing for containing the pin 11, latch 32, cam keeper 22, and stop 40. The housing preferably comprises a first, preferably female, housing component 50, and a second, typically male, housing component 51, the components 50, 51 seen in abutting contact with each other in FIG. 1, and being shown individually in FIGS. 13 through 15.

In the conventional cam-lock construction the hollow housing components 50, 51 are made of metal or a sturdy, structural plastic. According to the invention, however, the structural rigidity for holding the pin 11 and for mounting the cam shaft 19 is provided by the flanges 12, 26, the housing components 50, 51 (which are hollow) can be made out of inexpensive materials. Particularly suitable are primarily cellulosic materials, or non-structural plastics, such as vacuum formed plastics. Some examples of primarily cellulosic material that can be utilized include cardboard, corrugated paper, and paperboard, which may or may not have added fibers, fillers, or other materials. The second housing component 51 has side walls 52, 53 thereof which are engaged by the flange 26 surfaces 27, 28. Through extending opening 54 (see FIG. 13) is provided to allow passage of the cam shaft 19 therethrough.

Similarly the first housing component 50 has side walls 55, 56 thereof which are engaged by the flange side portions 13,14. The through extending opening 57 (see FIG. 14) is provided for receipt of the latching pin 11.

Figure 11:
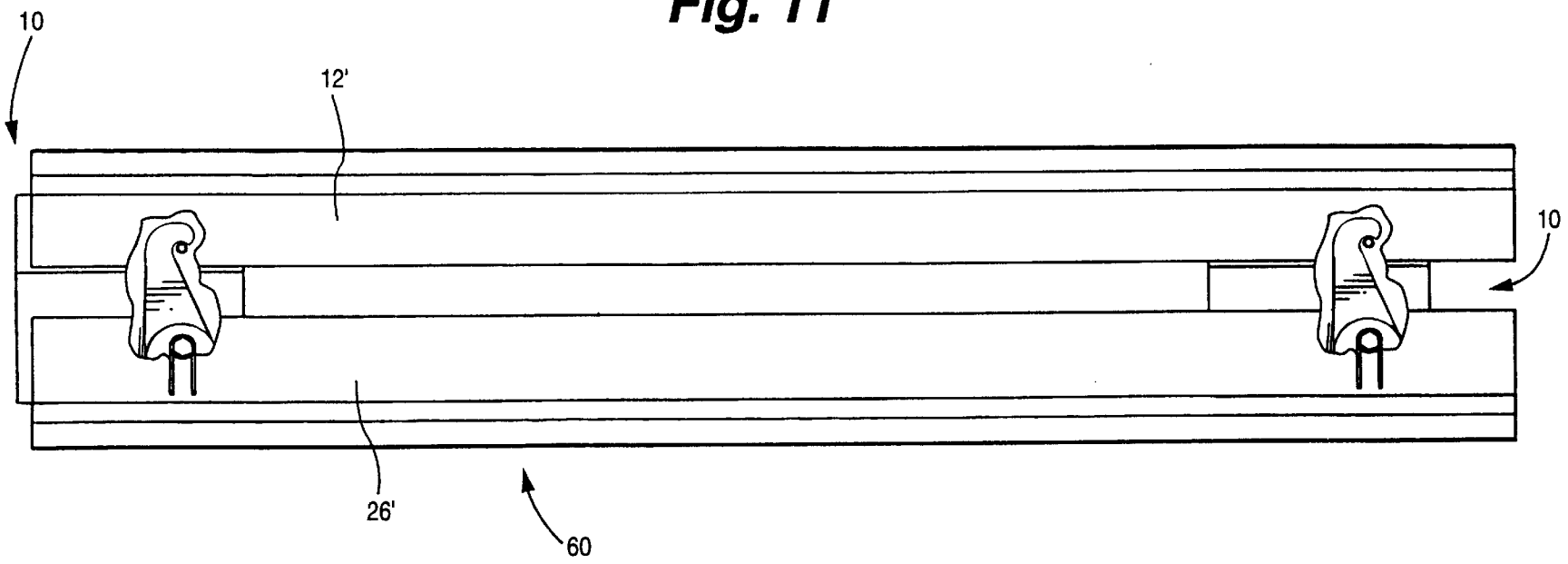
FIG. 11 is a view similar to that of FIG. 1 only showing two latching assemblies with common flange connections.

According to the present invention a pair of the latching assemblies 10 according to the invention—as seen in FIG. 11—may be provided in a configuration that dramatically improves the strength of the entire construction, as illustrated in FIG. 11. As seen in FIG. 11—shown by reference numerals 12' and 26' in FIG. 11—the flanges are elongated so as to span the distance between the adjacent latching assemblies 10. Use of these tied together latching assemblies, shown generally by reference numeral 60 in FIG. 11, are also seen in the illustration in FIG. 12, which shows foamed insulating panels forming the walls and roof of a large commercial cooler or freezer. The roof insulating panels are illustrated schematically at 61 in FIG. 12 while the wall insulating panels are indicated schematically by reference numeral 62 in FIG. 12.

In a typical utilization of the latching assembly 10 according to the present invention, the upper components comprising the first flange 12, first housing component 50, and latching pin 11, have a foamed insulating panel (e.g. 61) molded therearound using conventional techniques. During panel manufacture plugs may be used to reinforce the housing component 50 (provided in the hollow interior thereof). The plugs may be made of materials which act as a heat sink if the housing component 50 is of non-structural plastic. The pin 11 is passed through opening 57 and cooperating openings in the side walls 13, 14 of the flange 12, and the ends of the pin 11 are deformed as indicated at 15 in FIG. 2. The entire structure is placed in the mold for forming the foamed insulation panel and a foamed insulation panel—such as the panel 61 illustrated in FIG. 12—is formed utilizing otherwise conventional techniques.

Figure 12:
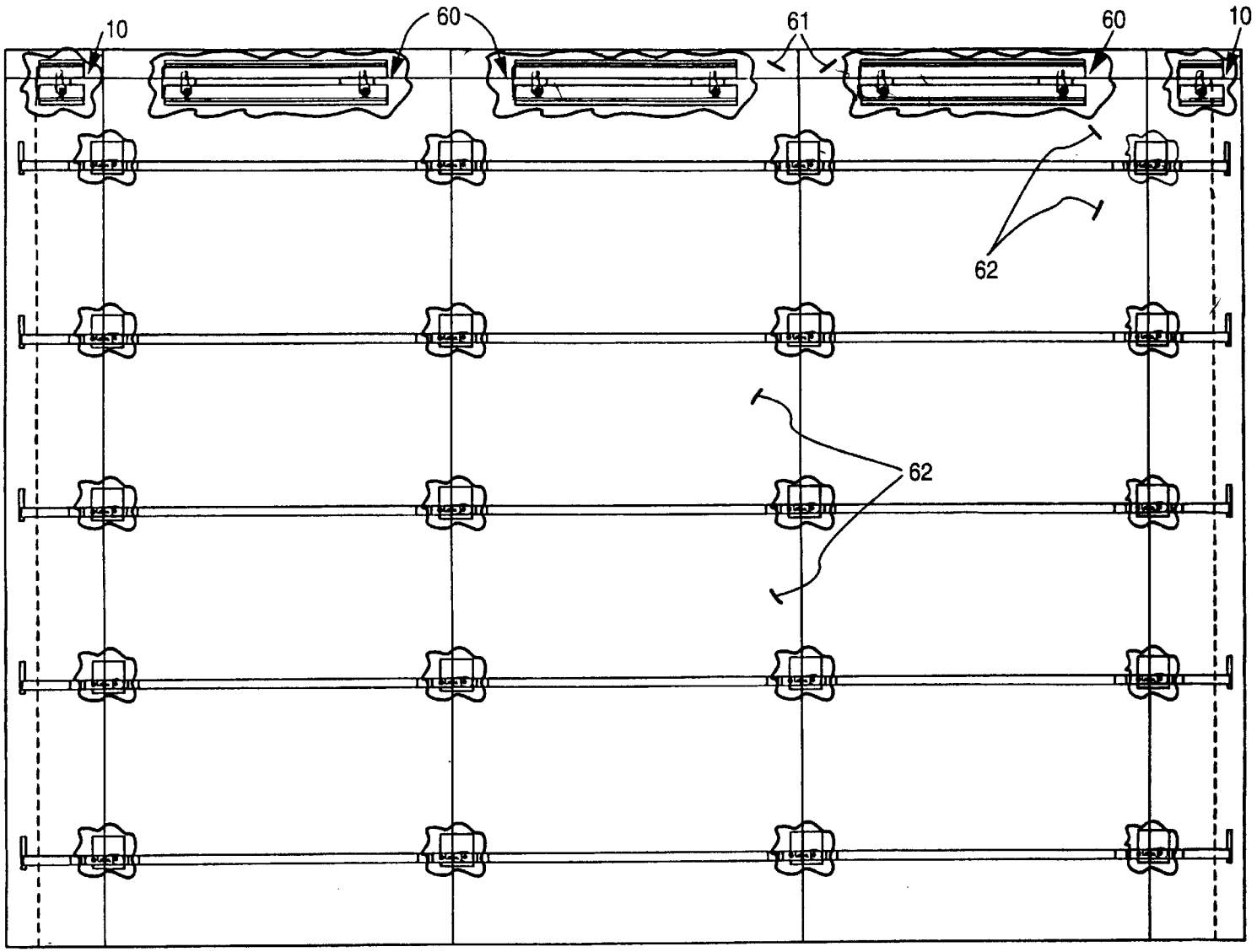
FIG. 12 is a side view showing a plurality of foam insulating panels connected together with latching assemblies according to the present invention, with the panels cut away where the latching assemblies are provided, and the latch components, even though in the housing and actually hidden thereby illustrated in solid line for clarity.

The bottom component in FIGS. 1 and 2 is formed in a similar way. That is the latch 32 is placed inside the housing 51 with the cam keeper 22 held in the opening 33 with the friction clutch 35, and the stop 40 is similarly placed inside the housing component 51 with the keeper pin 41 passing through the keeper pin receiving opening 42 in the cam keeper 22. Then the cam shaft 19 is passed through the opening 25 as well as through the opening 54 in housing component 51, and cooperating openings in the flange 26 side walls 27, 28 so that the cam/latch sub-assembly (see FIG. 10) is properly positioned within the housing component 51, and the tab 45 is spring pressed against the cam shaft 19. The foamed insulation panel (e.g. a panel 62) is then formed around the lower components in FIGS. 1 and 2 (again using plugs inside the housing component 51 if necessary or desirable) to cooperate with the panel 61 as illustrated in FIG. 12.

After the panels 61, 62 are moved into engagement with each other, a tool is used to engage the hex portion 20 of the cam shaft 19 to rotate the latch 32 so that the hook 34 thereof engages the latching pin 11 as illustrated in FIG. 1. The friction clutch 35 ensures that there is no relative movement between the latch 35 and the cam shaft 19 unless there is an external force applied to deliberately rotate the latch 32 with respect to the cam keeper 22. Similarly the external clutch 45 maintains the cam shaft 19 and the second flange 26 together unless the shaft 19 is positively rotated with respect to the second flange 26 by an external force.

It will thus be seen that according to the present invention an advantageous latching assembly, particularly for use in assembling or disassembling mating foamed insulating panels such as for the walls, roof or floor of large commercial coolers, freezers, or the like, is provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A latching assembly comprising:

a latching pin mounted to a first metal or structural plastic flange;

a cam shaft operatively mounted to a second metal or structural plastic flange;

a latch operatively connected to said cam shaft, said latch including a latch hook which cooperates with said latching pin to latch said first and second flanges together;

said first flange substantially integral with said latching pin, said latching pin extending in a direction of elongation with respect to said first flange; and said second flange mounting said cam shaft for rotation about an axis substantially parallel to said direction of elongation of said latching pin; and a housing of primarily cellulosic material or non-structural plastic formed by cooperating first and second hollow housing components each having first and second faces, said first metal flange engaging said first and second faces of said first housing component, and said second metal flange engaging said first and second faces of said second housing component; and wherein said latching pin, latch, and part of said cam shaft are disposed within said housing.

2. A latching assembly as recited in claim 1 further comprising an external clutch, comprising a spring loaded tab integral with said second flange, exerting a force on said cam shaft to maintain said cam shaft and said second metal or structural plastic flange together until said cam shaft is positively rotated with respect to said second flange by an external force.

3. A latching assembly as recited in claim 1 further comprising, foamed thermal insulation encompassing each said housing component except at a portion of each which cooperates with the other housing component.

4. A latching assembly as recited in claim 1 wherein said housing components are male and female components of corrugated paper, paperboard, or cardboard.

5. A latching assembly comprising:

a latching pin mounted to a first metal or structural plastic flange or panel;

a cam shaft operatively mounted to a second metal or structural plastic flange or panel;

a latch operatively connected to said cam shaft, said latch including a latch hook which cooperates with said latching pin to latch said first and second flanges or panels together; and an external clutch associated with said second metal or structural plastic flange or panel and exerting a force on said cam shaft to maintain said cam shaft and said second metal or structural plastic flange or panel together until said cam shaft is positively rotated with respect to said second flange by an external force, said external clutch comprising a spring loaded tab integral with said second flange or panel.

6. A latching assembly as recited in claim 5 wherein said first and second flanges or panels comprise a first metal or structural plastic flange substantially integral with said latching pin, said latching pin extending in a direction of elongation with respect to said first flange; and a second metal or structural plastic flange which mounts said cam shaft for rotation about an axis substantially parallel to said direction of elongation of said latching pin; and further comprising a housing of primarily cellulosic material or non-structural plastic formed by cooperating male and female hollow housing components each having first and second faces, said first metal flange engaging said first and second faces of one housing component, and said second metal flange engaging said first and second faces of the other housing, said latching pin, latch, and part of said cam shaft disposed within said housing.

7. A latching assembly comprising:

a latching pin mounted to a first flange or panel;

a cam shaft having a center, and having a cam keeper positioned thereon, said cam shaft operatively mounted to a second flange or panel;

said first and second flanges or panels comprising a first metal or structural plastic flange substantially integral with said latching pin, said latching pin extending in a direction of elongation with respect to said first flange; and a second metal or structural plastic flange which mounts said cam shaft for rotation about an axis substantially parallel to said direction of elongation of said latching pin;

said cam keeper having a substantially peripheral surface, a center, and an opening through which said cam shaft passes having the center thereof radially spaced from said cam keeper center;

a latch having an opening therein for receipt of said cam keeper, said latch including a latch hook which cooperates with said latching pin to latch said first and second flanges or panels together;

a friction clutch which supplies at least one of a radial and axial spring force from the exterior of said cam shaft to said cam keeper so as to provide frictional contact between said latch at said opening and said cam keeper, said force of sufficient magnitude and precision to ensure that said latch rotates with said cam shaft unless an external force is applied to deliberately rotate said latch with respect to said cam shaft; and a housing of primarily cellulosic material or non-structural plastic formed by cooperating first and second hollow housing components each having first and second faces, said first metal flange engaging said first and second faces of said first housing component; and wherein said second metal flange engaging said first and second faces of said second housing component, said latching pin, latch, and cam keeper are disposed within said housing.

8. A latching assembly as recited in claim 7 further comprising, foamed thermal insulation encompassing each said housing component except at a portion of each which cooperates with the other housing component.

9. A latching assembly as recited in claim 7 wherein said friction clutch comprises a cantilevered tongue integral with said latch and having a portion thereof extending into spring-pressed engagement with said cam keeper substantially peripheral surface.

10. A latching assembly as recited in claim 9 wherein said tongue includes a thinned portion to provide flexibility thereof.

11. A latching assembly as recited in claim 9 further comprising a stop substantially integral with said cam shaft and having a keeper pin extending axially outwardly therefrom substantially parallel to said cam shaft; and wherein said cam keeper has a keeper pin-receiving opening formed therein for receipt of said keeper pin to stabilize the position of said cam keeper on said cam shaft.

12. A latching assembly as recited in claim 11 wherein said cam shaft comprises a non-round end surface for engagement by a cooperating non-round tool element to effect rotation thereof.

13. A latching assembly comprising:

a latching pin mounted to a first flange or panel;

a cam shaft having a center, and having a cam keeper positioned thereon, said cam shaft operatively mounted to a second flange or panel;

said first and second flanges or panels comprising a first metal or structural plastic flange substantially integral with said latching pin, said latching pin extending in a direction of elongation with respect to said first flange; and a second metal or structural plastic flange which mounts said cam shaft for rotation about an axis substantially parallel to said direction of elongation of said latching pin;

said cam keeper having a substantially peripheral surface, a center, and an opening through which said cam shaft passes having the center thereof radially spaced from said cam keeper center;

a latch having an opening therein for receipt of said cam keeper, said latch including a latch hook which cooperates with said latching pin to latch said first and second flanges or panels together;

a friction clutch which supplies at least one of a radial and axial spring force from the exterior of said cam shaft to said cam keeper so as to provide frictional contact between said latch at said opening and said cam keeper, said force of sufficient magnitude and precision to ensure that said latch rotates with said cam shaft unless an external force is applied to deliberately rotate said latch with respect to said cam shaft; and an external clutch associated with said second metal or structural plastic flange and exerting a force on said cam shaft to maintain said cam shaft and said second metal or structural plastic flange together until said cam shaft is positively rotated with respect to said second flange by an external force.

14. A latching assembly as recited in claim 13 wherein said external clutch comprises a spring loaded tab integral with said second flange.

15. A latching assembly as recited in claim 13 wherein said friction clutch comprises a cantilevered tongue integral with said latch and having a portion thereof extending into spring pressed engagement with said cam keeper substantially peripheral surface.

16. A latching assembly as recited in claim 15 wherein said tongue includes a thinned portion to provide flexibility thereof.

17. A latching assembly as recited in claim 13 further comprising a stop substantially integral with said cam shaft and having a keeper pin extending axially outwardly therefrom substantially parallel to said cam shaft; wherein said cam keeper has a keeper pin-receiving opening formed therein for receipt of said keeper pin to stabilize the position of said cam keeper on said cam shaft.

18. A latching assembly comprising:

a latching pin mounted to a first metal or structural plastic flange;

a cam shaft operatively mounted to a second metal or structural plastic flange;

a latch operatively connected to said cam shaft, said latch including a latch hook which cooperates with said latching pin to latch said first and second flanges together;

said first flange substantially integral with said latching pin, said latching pin extending in a direction of elongation with respect to said first flange; and said second flange mounting said cam shaft for rotation about an axis substantially parallel to said direction of elongation of said latching pin; and an external clutch, comprising a spring loaded tab integral with said second flange, exerting a force on said cam shaft to maintain said cam shaft and said second metal or structural plastic flange together until said cam shaft is positively rotated with respect to said second flange by an external force.

19. A latching assembly comprising:

a latching pin mounted to a first metal or structural plastic flange or panel;

a cam shaft operatively mounted to a second metal or structural plastic flange or panel;

wherein said first and second flanges or panels comprise a first metal or structural plastic flange substantially integral with said latching pin, said latching pin extending in a direction of elongation with respect to said first flange; and a second metal or structural plastic flange which mounts said cam shaft for rotation about an axis substantially parallel to said direction of elongation of said latching pin;

a latch operatively connected to said cam shaft, said latch including a latch hook which cooperates with said latching pin to latch said first and second flanges or panels together;

an external clutch associated with said second metal or structural plastic flange or panel and exerting a force on said cam shaft to maintain said cam shaft and said second metal or structural plastic flange or panel together until said cam shaft is positively rotated with respect to said second flange by an external force; and a housing of primarily cellulosic material or non-structural plastic formed by cooperating male and female hollow housing components each having first and second faces, said first metal flange engaging said first and second faces of one housing component, and said second metal flange engaging said first and second faces of the other housing, said latching pin, latch, and part of said cam shaft disposed within said housing.

20. A latching system comprising the latching assembly of claim 13 in combination with a second latching assembly which is the same as said latching assembly; and wherein said first and second flanges are elongated; and both said latching assemblies are mounted to said first and second flanges spaced from each other in a dimension substantially perpendicular to said axis of rotation of said cam shafts, and so that said cam shafts of said latching assemblies are substantially parallel to each other.

21. A latching system comprising the latching assembly of claim 1 in combination with a second latching assembly which is the same as said latching assembly; and wherein said first and second flanges are elongated; and both said latching assemblies are mounted to said first and second flanges spaced from each other in a dimension substantially perpendicular to said axis of rotation of said cam shafts, and so that said cam shafts of said latching assemblies are substantially parallel to each other.

* * * * *